US008667946B2

(12) United States Patent
Mori et al.

(10) Patent No.: US 8,667,946 B2
(45) Date of Patent: Mar. 11, 2014

(54) MULTI-CYLINDER ENGINE HAVING COMMUNICATING PASSAGES BETWEEN CYLINDER BORES

(75) Inventors: Masaki Mori, Shizuoka-Ken (JP); Tomoyuki Oda, Shizuoka-Ken (JP)

(73) Assignee: Suzuki Motor Corporation, Hamamatsu-shi, Shizuoka-Ken (JP)

( * ) Notice: Subject to any disclaimer, the term of this patent is extended or adjusted under 35 U.S.C. 154(b) by 458 days.

(21) Appl. No.: 13/182,606

(22) Filed: Jul. 14, 2011

(65) Prior Publication Data

US 2012/0012079 A1 Jan. 19, 2012

(30) Foreign Application Priority Data

Jul. 15, 2010 (JP) ..... 2010-160684
Jul. 21, 2010 (JP) ..... 2010-164294

(51) Int. Cl.
*F02B 75/22* (2006.01)

(52) U.S. Cl.
USPC ..... 123/195 R; 123/311

(58) Field of Classification Search
USPC ..... 123/195 R, 311
See application file for complete search history.

(56) References Cited

U.S. PATENT DOCUMENTS 7,096,843 B2 * 8/2006 Kawamoto et al. ..... 123/195 R
8,104,175 B2 * 1/2012 Mochida ..... 29/888.06

FOREIGN PATENT DOCUMENTS

JP 08261055 10/1996
JP 2005069170 3/2005

* cited by examiner

*Primary Examiner* — Marguerite McMahon
*Assistant Examiner* — James Kim
(74) *Attorney, Agent, or Firm* — Barnes & Thornburg LLP

(57) ABSTRACT

A multi-cylinder engine with a crankcase integrated cylinder block including a cylinder block having a plurality of cylinder bores, a plurality of crank chambers formed by an upper crankcase and a lower crankcase, a bulkhead that partitions between the cylinder bores and the crank chambers, and a honing release portion having a cylindrical honing release surface formed continuously with the cylinder bore in the upper crankcase and the bulkhead. The honing release surface forms an arcuate recessed portion in the bulkhead, the bulkhead is formed with a communication hole that includes a first opening edge on a side of the cylinder bore, a second opening edge on a side of the crank chamber having an opening width decreasing with a distance from the cylinder bore, and a third opening edge that extends substantially in parallel with the cylinder axis.

7 Claims, 11 Drawing Sheets

MULTI-CYLINDER ENGINE HAVING COMMUNICATING PASSAGES BETWEEN CYLINDER BORES

PRIORITY CLAIM

This patent application claims priority to Japanese Patent Application No. 2010-164294, filed Jul. 21, 2010, and Japanese Patent Application No. 2010-160684, filed Jul. 15, 2010, the disclosures of which are incorporated herein by reference in their entirety.

BACKGROUND

1. Field of the Invention

Disclosed embodiments relate to a multi-cylinder engine particularly provided with a crankcase integrated cylinder block.

2. Related Art

For a multi-cylinder engine, particularly, a multi-cylinder four-stroke cycle engine mounted in a motorcycle, in order to reduce the number of components or assembling steps, there is known a multi-cylinder engine including a crankcase integrated cylinder block in which a cylinder block including a cylinder bore and an upper crankcase that forms an upper half of a crank chamber are integrally formed.

Such a multi-cylinder engine including a crankcase integrated cylinder block includes a bulkhead (or partition wall) that partitions between adjacent cylinder bores and crank chambers, and the bulkhead has a communication hole that provides communication between the adjacent crank chambers. The communication hole acts to reduce pump loss caused by compression of air in a crank chamber in a piston downward-moving process or to reduce resistance to stirring caused by oil splashed in the crank chamber and mixed with air (for example, see Patent Document 1 (Japanese Patent Laid-Open Publication No. 2005-69170)).

In order to reduce a weight of an engine, a crankcase integrated cylinder block is formed of an aluminum alloy by casting. In this case, a cylinder inner wall surface, that is a slide surface with respect to a piston and forms a cylinder bore, is plated with metal such as nickel to prevent adhesion wear to the piston.

A method of plating the cylinder inner wall surface includes a so-called dipping method performed by dipping the entire crankcase integrated cylinder block in a treatment tank, and a method of blocking a crank chamber side end of a cylinder bore with a jig, and passing a plating solution from a cylinder head side of the cylinder bore (for example, see Patent Document 2 (Japanese Patent Laid-Open Publication No. 8-261055)). The method of blocking one end of the cylinder bore consumes smaller amounts of various plating solutions and requires less treatment time than the so-called dipping method.

The method of blocking one end of the cylinder bore to plate the cylinder inner wall surface described in Patent Document 2 requires a seal surface, which is not required in the so-called dipping method. The seal surface is a surface against which the jig to block the crank chamber side end of the cylinder bore is abutted, and a surface for keeping the inside of the cylinder bore liquid-tight so as to prevent the various plating solutions from leaking from the cylinder bore.

The crankcase integrated cylinder block includes a honing release portion having a honing release surface with a diameter larger than the cylinder bore continuously with the crank chamber side end of the cylinder bore. The honing release surface is a surface for releasing a honing edge of a honing machine in honing a cylinder bore, and used as a seal surface in plating the cylinder inner wall surface.

The crankcase integrated cylinder block has a communication hole that provides communication between adjacent crank chambers. The communication hole is positioned closer to a crank chamber than a lower end of a piston ring or a piston skirt at the lowermost stage of the piston at a bottom dead center in a boundary between the cylinder bore and the crank chamber, that is, near the honing release surface.

Thus, if an opening diameter of the communication hole is simply increased to further the reduce pump loss or resistance to stirring, the communication hole divides the honing release surface, and the method of blocking one end of the cylinder bore to plate the cylinder inner wall surface cannot be applied.

On the other hand, incidentally, the bulkhead partitioning the cylinder bore and the crank chamber also includes a bearing half portion that constitutes a journal bearing portion in which a crankshaft is journaled, and the engine includes a bearing cap that constitutes a journal bearing together with the bearing half portion of the bulkhead. The bearing cap is secured by fastening a fastening member such as a bolt in a fastening hole formed in the bulkhead. The fastening hole is, a so-called bolt hole, includes a female screw portion, and is placed adjacent to the bearing half portion.

That is, there is also known a crankcase integrated cylinder block having a rounded rectangular communication hole extending in a direction perpendicular to a cylinder axis, that is, a circumferential direction of a cylindrical surface that forms a cylinder bore (for example, see Patent Document 1).

For the communication hole extending in the direction perpendicular to the cylinder axis, a fastening hole for fastening a bearing cap to a bulkhead or a prepared hole thereof is placed close to an opening edge of a communication hole, which may reduce strength and durability against damage that occurs in the fastening hole or the prepared hole.

The bulkhead also includes a bearing half portion that constitutes a journal bearing portion in which a crankshaft is journaled, and the engine includes a bearing cap that constitutes a journal bearing together with the bearing half portion of the bulkhead. The bearing cap is secured by fastening a fastening member such as a bolt in a fastening hole formed in the bulkhead. The fastening hole is, a so-called bolt hole, includes a female screw portion, and is placed adjacent to the bearing half portion.

A crankcase integrated cylinder block has been known having a rounded rectangular communication hole extending in a direction perpendicular to a cylinder axis, that is, a circumferential direction of a cylindrical surface that forms a cylinder bore (for example, see Patent Document 1).

For the communication hole extending in the direction perpendicular to the cylinder axis, a fastening hole for fastening a bearing cap to a bulkhead or a prepared hole thereof is placed close to an opening edge of a communication hole, which may reduce strength and durability against damage that occurs in the fastening hole or the prepared hole.

SUMMARY

Disclosed embodiments were conceived in consideration of the circumstances encountered in the prior art mentioned above. Disclosed embodiments provide a multi-cylinder engine provided with a crankcase integrated cylinder block in which a communication hole having a maximum opening area is formed in a bulkhead that partitions a cylinder bore and a crank chamber without dividing a honing release surface formed continuously with the cylinder bore.

Disclosed embodiments also provide a multi-cylinder engine provided with a crankcase integrated cylinder block capable of providing a sufficient clearance between a fastening hole for fastening a bearing cap or a prepared hole (pilot bolt hole) thereof and an opening edge of a communication hole, and improving strength and durability against damage that occurs in the fastening hole or the pilot bolt hole.

According to disclosed embodiments, these features can be achieved by providing, in one aspect, a multi-cylinder engine which includes a cylinder block including a plurality of cylinder bores; an upper crankcase and a lower crankcase that form, in combination, a plurality of crank chambers corresponding to the cylinder bores; a bulkhead that partitions between the cylinder bores and the crank chambers adjacent to each other; and a honing release portion having a cylindrical honing release surface formed continuously with the cylinder bore in the upper crankcase and the bulkhead, wherein the cylinder block and the upper crankcase are formed integrally, the honing release surface is formed with a diameter larger than the cylinder bore, and an arcuate recessed portion is formed in the bulkhead, the bulkhead is formed with a communication hole that communicates with the crank chambers adjacent each other, the bulkhead including a first opening edge on a side of the cylinder bore extending in a direction substantially perpendicular to a cylinder axis, a second opening edge on a side of the crank chamber having an opening width decreasing with a distance from the cylinder bore, and a third opening edge that extends substantially in parallel with the cylinder axis and connects between the first opening edge and the second opening edge, and the second opening edge is formed from the cylinder bore to the recessed portion to prevent the honing release surface from being divided.

According to at least one disclosed embodiment, in the multi-cylinder engine, the crankcase integrated cylinder block can be formed with a communication hole having a maximum opening area in the bulkhead that partitions the cylinder bore and the crank chamber without dividing the honing release surface formed continuously with the cylinder bore.

According to another disclosed embodiment, these features can be also achieved by providing a multi-cylinder engine including a cylinder block including a plurality of cylinder bores; an upper crankcase and a lower crankcase that form, in combination, a plurality of crank chambers corresponding to the cylinder bores, the upper crankcase being formed integrally with the cylinder block; and a bulkhead that partitions between the cylinder bores and the crank chambers adjacent to each other, wherein the bulkhead is formed with a communication hole that includes a first opening edge on a side of the cylinder bore extending in a direction substantially perpendicular to a cylinder axis and a second opening edge on a side of the crank chamber having an opening width decreasing with a distance from the cylinder bore so as to establish communication between the cylinder bores and the crank chambers adjacent to each other; a bearing half portion that constitutes a journal bearing in which a crankshaft is journaled in a joint surface between the bearing half portion and the lower crankcase; and a pilot bolt hole as a fastening hole for a fastening member for fastening, to the bulkhead, a bearing cap that constitutes the journal bearing together with the bearing half portion, and wherein a clearance between the communication hole and the pilot bolt hole is larger than a clearance between a circle whose diameter is a maximum opening width of the communication hole in a direction of the cylinder axis and the pilot bolt hole.

According to at least one disclosed embodiment, in the crankcase integrated cylinder block of the multi-cylinder engine, the fastening hole or the pilot bolt hole thereof for fastening the bearing cap is sufficiently separated in structure from the opening edge of the communication hole, thus improving the strength and durability against damage which may be caused from the fastening hole or prepared pilot bolt hole.

The nature and further characteristic features will be made clearer from preferred embodiment described hereunder with reference to the accompanying drawings.

DESCRIPTION OF THE DISCLOSED EMBODIMENTS

Embodiments of a multi-cylinder engine provided with a crankcase integrated cylinder block according to the present invention will be described hereunder with reference to FIGS. 1 to 11. It is further to be noted that terms "upper", "lower", "right", "left" and the like terms indicating direction or like are used herein with reference to the illustrations of the drawings and an actually installed state of the engine.

Figure 1:
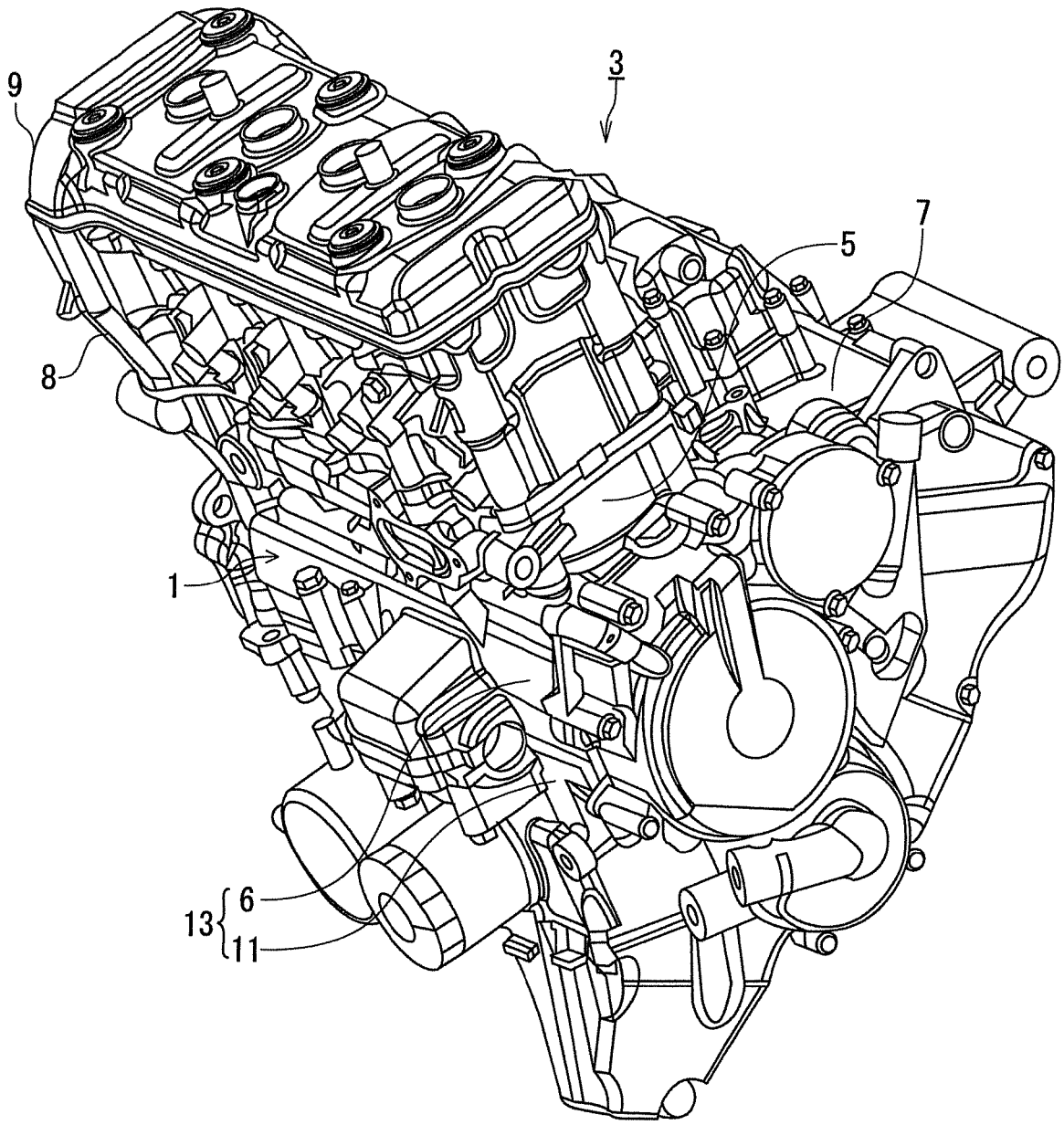
FIG. 1 is a perspective view showing an engine to which a crankcase integrated cylinder block of a multi-cylinder engine according to one disclosed embodiment is applied.
Figure 2:
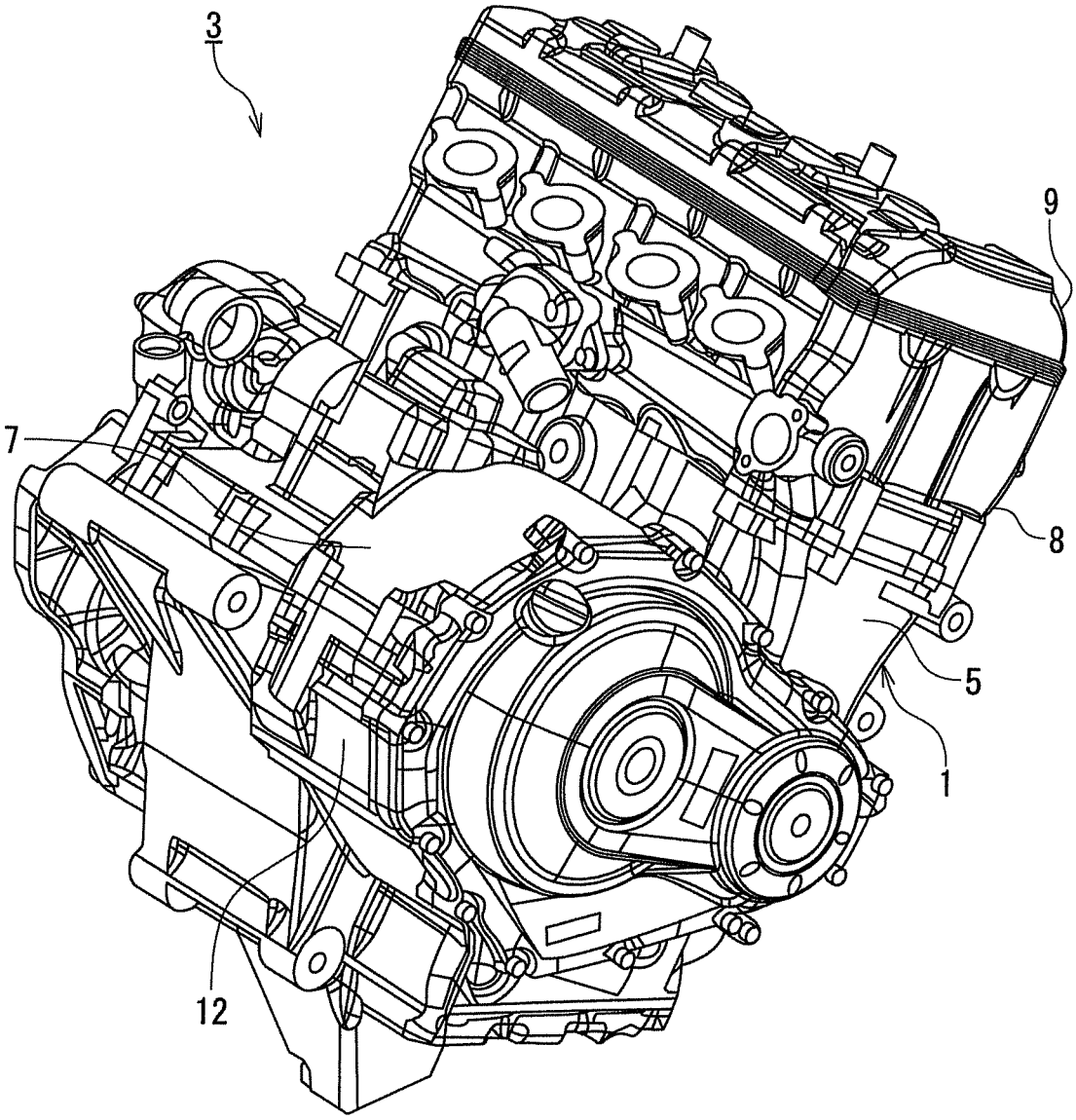
FIG. 2 is a perspective view showing the engine to which the crankcase integrated cylinder block, viewed from a different direction from that of FIG. 1, according to another disclosed embodiment is applied.

As shown in FIGS. 1 and 2, an engine (multi-cylinder engine) 3, to which the crankcase integrated cylinder block 1 is applied, is a four-cycle multi-cylinder engine, and more specifically, an in-line four-cylinder engine including four cylinders arranged in series. The engine 3 may include a plurality of cylinders without being limited to four cylinders.

The engine 3 is provided with the crankcase integrated cylinder block 1 including a cylinder block 5, an upper crankcase 6, and an upper transmission case 7 integrally formed, and the crankcase integrated cylinder block 1 further includes a cylinder head 8 provided on an upper surface of the cylinder block 5, a head cover 9 provided on an upper surface of the cylinder head 8, a lower crankcase 11 provided on a lower surface of the upper crankcase 6, and a lower transmission case 12 formed on a lower surface of the upper transmission case 7 and formed integrally with the lower crankcase 11.

The upper crankcase 6 and the lower crankcase 11 constitute a crankcase body (merely called crankcase, hereunder) 13.

Figure 3:
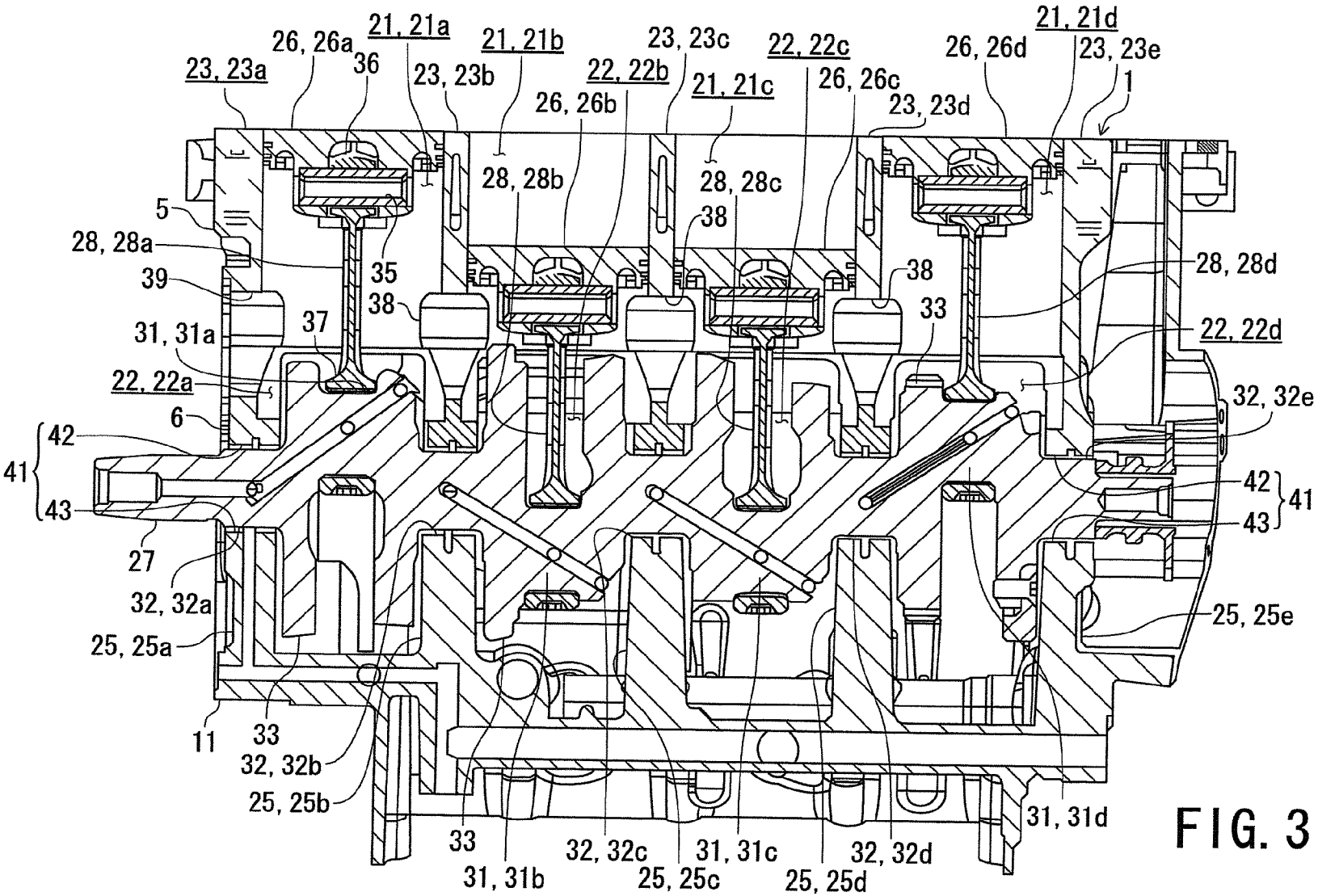
FIG. 3 is a sectional view showing a cylinder block and a crankcase of the multi-cylinder engine to which the crankcase integrated cylinder block is applied.
Figure 4:
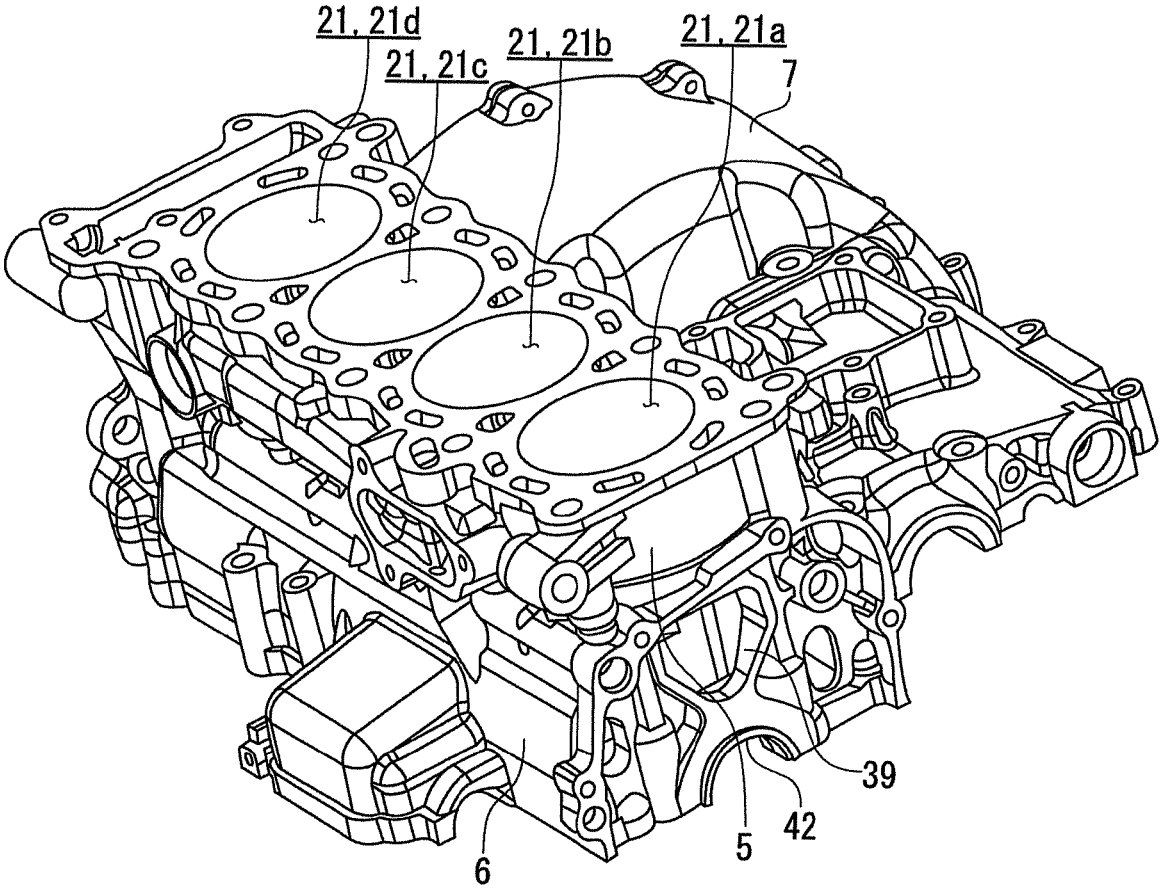
FIG. 4 is a perspective view showing the crankcase integrated cylinder block of the multi-cylinder engine according to the disclosed embodiments.
Figure 5:
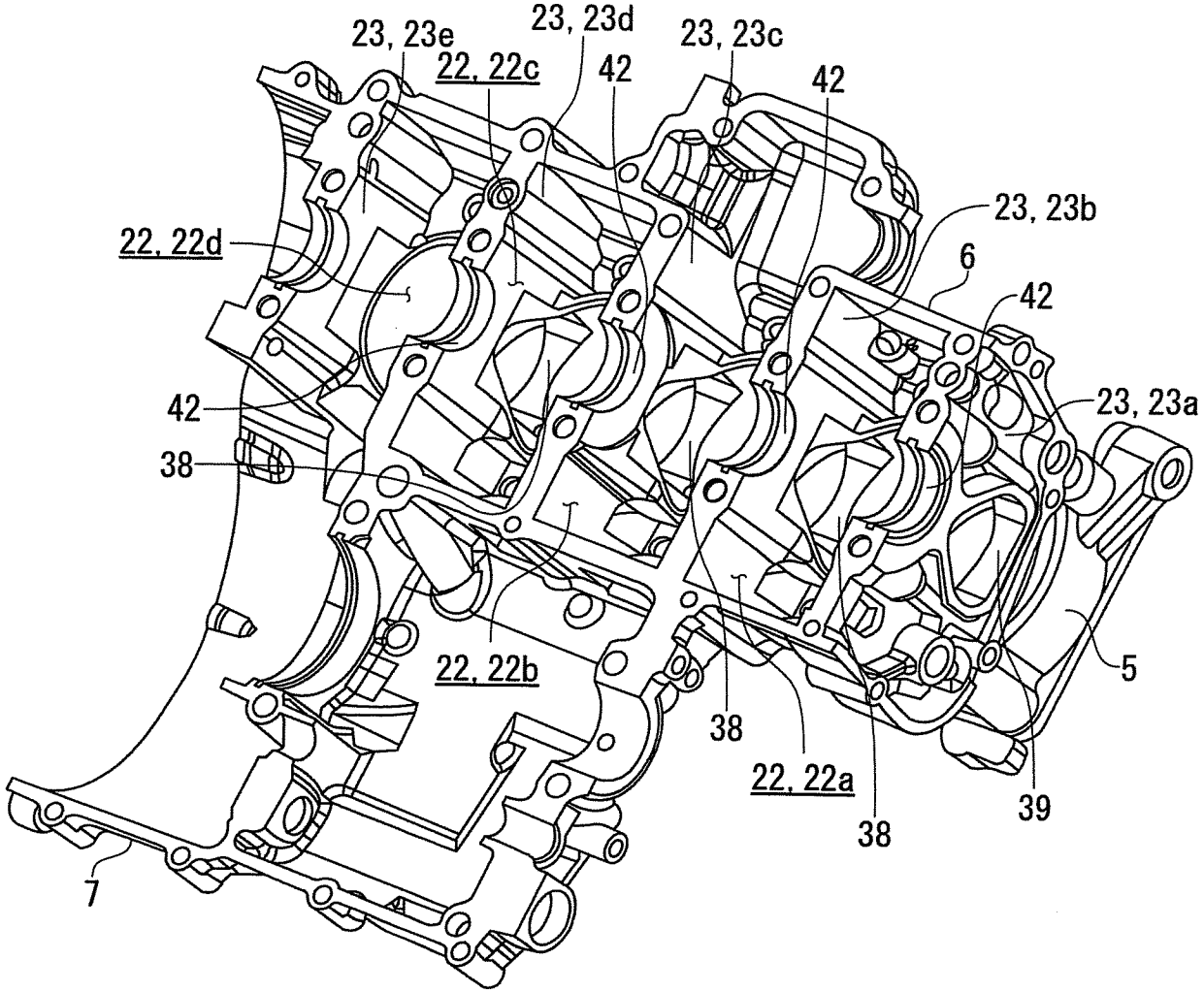
FIG. 5 is a perspective view showing the crankcase integrated cylinder block of a multi-cylinder engine, viewed from a different direction from that of FIG. 1, according to another disclosed embodiment.

Next, as shown in FIGS. 3 to 5, the crankcase integrated cylinder block 1 of the multi-cylinder engine according to this embodiment includes the cylinder block 5 and the upper crankcase 6 integrally casted, and includes the cylinder block 5 including a plurality of cylinder bores 21 (herein, four cylinder bores 21*a*, 21*b*, 21*c* and 21*d*), the upper crankcase 6 that forms a plurality of crank chambers 22 (herein, four crank chambers 22*a*, 22*b*, 22*c* and 22*d*) corresponding to the cylinder bores 21 together with the lower crankcase 11, and an upper bulkhead or partition wall (bulkhead) 23 that partitions between the cylinder bores 21 and the crank chambers 22.

The lower crankcase 11 is assembled to the upper crankcase 6 to thereby constitute the crank chamber 22. The lower crankcase 11 includes lower bulkheads 25 opposing respectively to the upper bulkheads 23 of the upper crankcase 6.

The engine 3 includes a plurality of pistons 26 (herein, four pistons 26*a*, 26*b*, 26*c* and 26*d*) inserted into the cylinder bore 21 to be reciprocally movable, a crankshaft 27 journaled in the crank chamber 22, and a plurality of connecting rods 28 (herein, four connecting rods 28*a*, 28*b*, 28*c* and 28*d*) that convert reciprocating motion of the piston 26 into rotational motion of the crankshaft 27.

The crankshaft 27 includes crank pins 31 (herein, four crank pins 31*a*, 31*b*, 31*c* and 31*d*) that constitute a plurality of eccentric shafts corresponding to the pistons 26, a plurality of crank journals 32 (herein, five crank journals 32*a*, 32*b*, 32*c*, 32*d* and 32*e*) that are main shafts of the crankshaft 27 and disposed on opposite sides of each crank pin 31, and a crank web 33 that connects between the crank pin 31 and the crank journal 32.

The connecting rod 28 includes a small end 36 journaled on a piston pin 35 provided in the piston 26, and a large end 37 journaled on the crank pin 31, and connect the piston 26 and the crankshaft 27 to each other.

The upper bulkhead 23 of the upper crankcase 6 and the lower bulkhead 25 of the lower crankcase 11 partition (section) between the cylinder bores 21 and the crank chambers 22 adjacent to each other, and partition, from outside, the cylinder bores 21 and the crank chambers 22 placed at the end portions, and hence, the upper bulkheads and lower bulkheads of the number larger, one in number, than the number of cylinders are provided (herein, five upper bulkheads 23*a*, 23*b*, 23*c*, 23*d* and 23*e* and five lower bulkheads 25*a*, 25*b*, 25*c*, 25*d* and 25*e*).

The upper bulkhead 23 is formed with a communication hole 38 establishing the communication between the cylinder bores 21 and the crank chambers 22 adjacent to each other. The communication hole 38 is located at a position closer to the crank chamber 22 than a lower end of a piston ring, not shown, or a piston skirt at a lowermost stage of the piston 26 at a bottom dead center in a boundary between the cylinder bore 21 and the crank chamber 22. Each communication hole 38 is formed substantially in parallel with a rotating axis of the crankshaft 27.

The upper bulkhead 23 includes a bearing upper half portion 42 (bearing half portion) that constitutes a journal bearing 41 in which the crankshaft 27 is journaled in a joint surface between the upper bulkhead 23 and the lower crankcase 11. On the other hand, the lower bulkhead 25 includes a bearing lower half portion 43 as a bearing cap that constitutes the journal bearing 41 together with the bearing upper half portion 42. The bearing upper half portion 42 and the bearing lower half portion 43 are formed as arcuate groove in the upper bulkhead 23 or the lower bulkhead 25, respectively.

Figure 6:
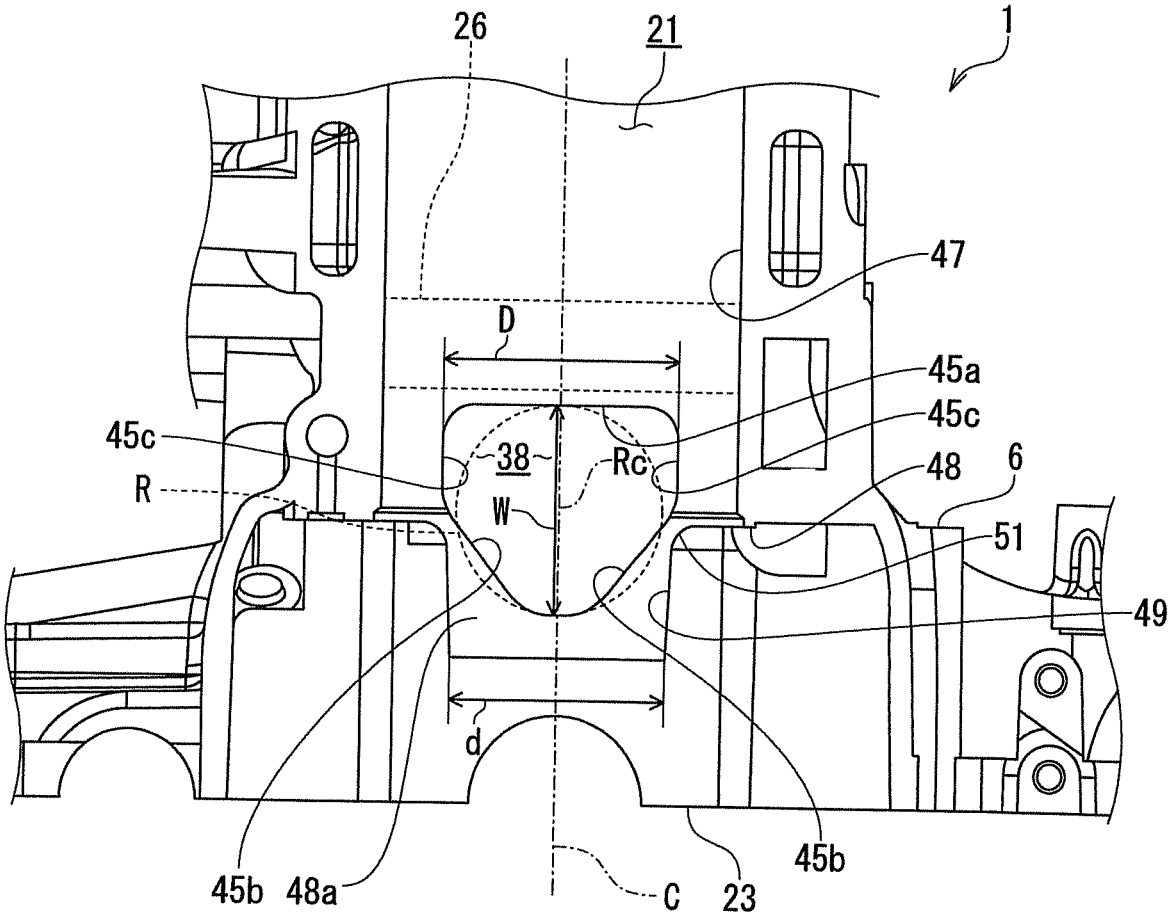
FIG. 6 is an illustrated sectional view showing a communication hole region of the crankcase integrated cylinder block of a multi-cylinder engine according to the disclosed embodiments.

FIG. 6 is a sectional view showing a communication hole region of the crankcase integrated cylinder block of a multi-cylinder engine according to the embodiment of the present invention.

Figure 7:
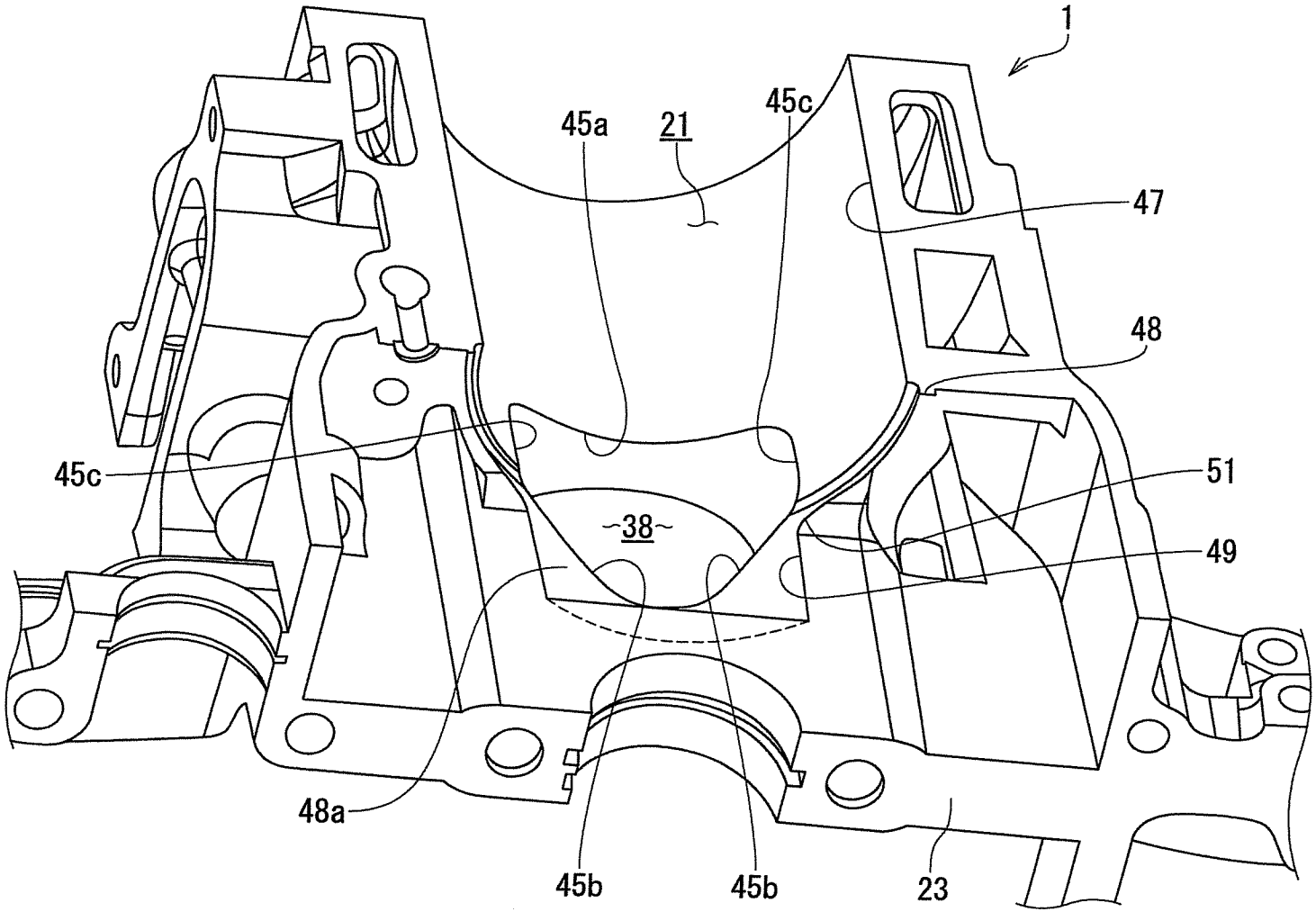
FIG. 7 is an illustrated perspective sectional view showing the communication hole region of the crankcase integrated cylinder block according to the disclosed embodiments.
Figure 8:
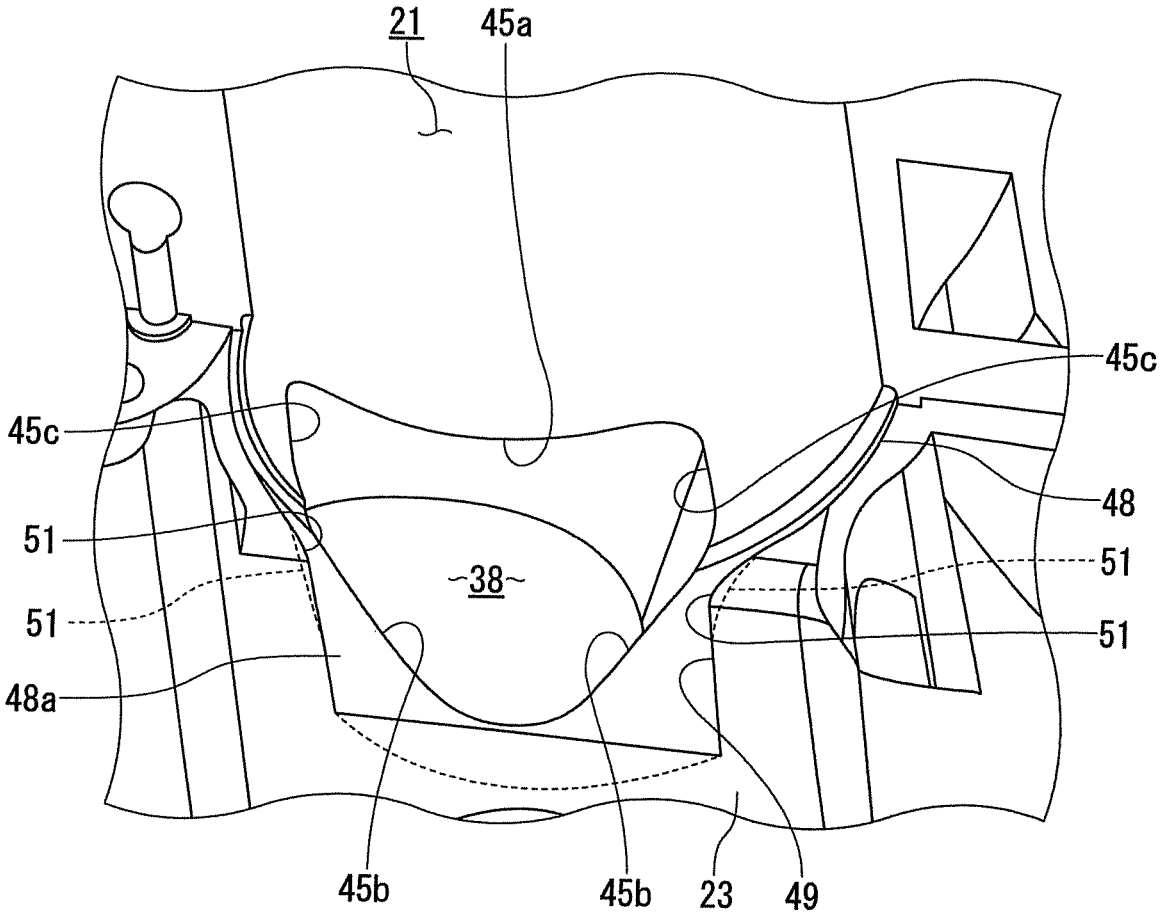
FIG. 8 is an enlarged perspective view showing the communication hole region of the crankcase integrated cylinder block according to the disclosed embodiments.
Figure 9:
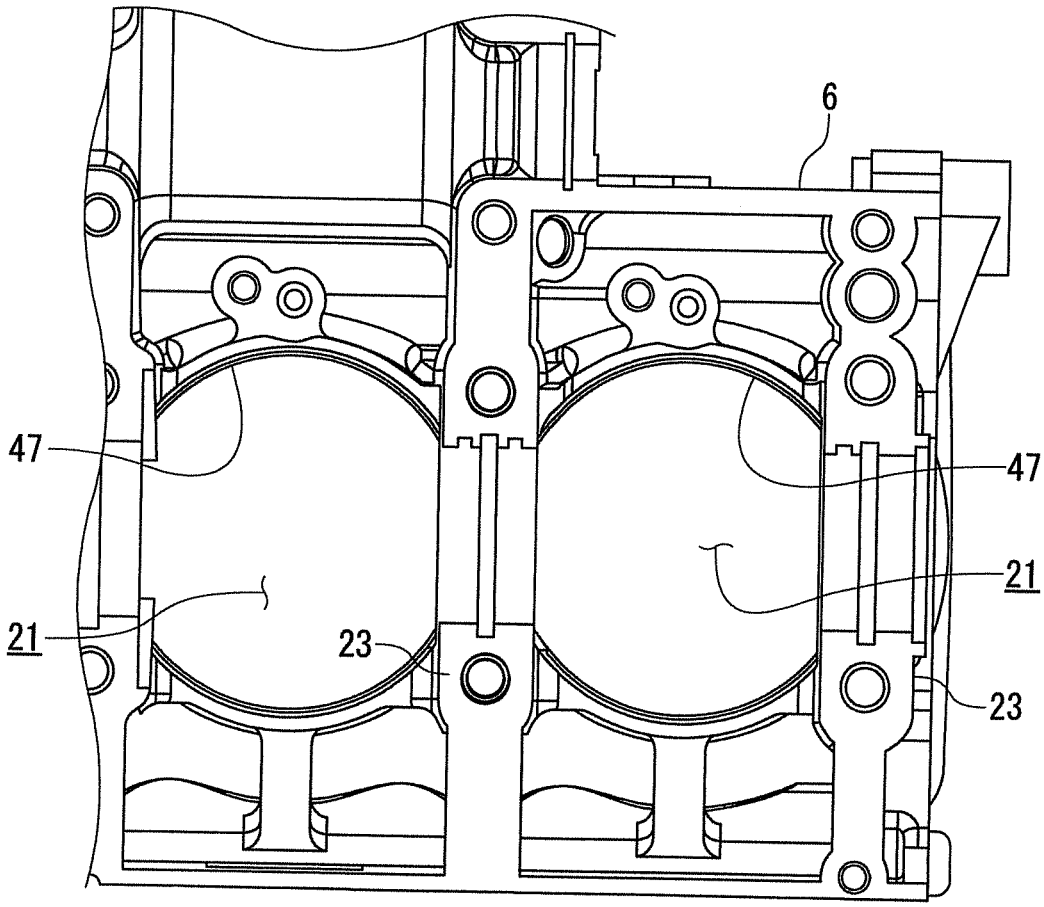
FIG. 9 is a bottom view showing a relationship between a cylinder bore and a bulkhead of the crankcase integrated cylinder block of the multi-cylinder engine according to the disclosed embodiments.
Figure 10:
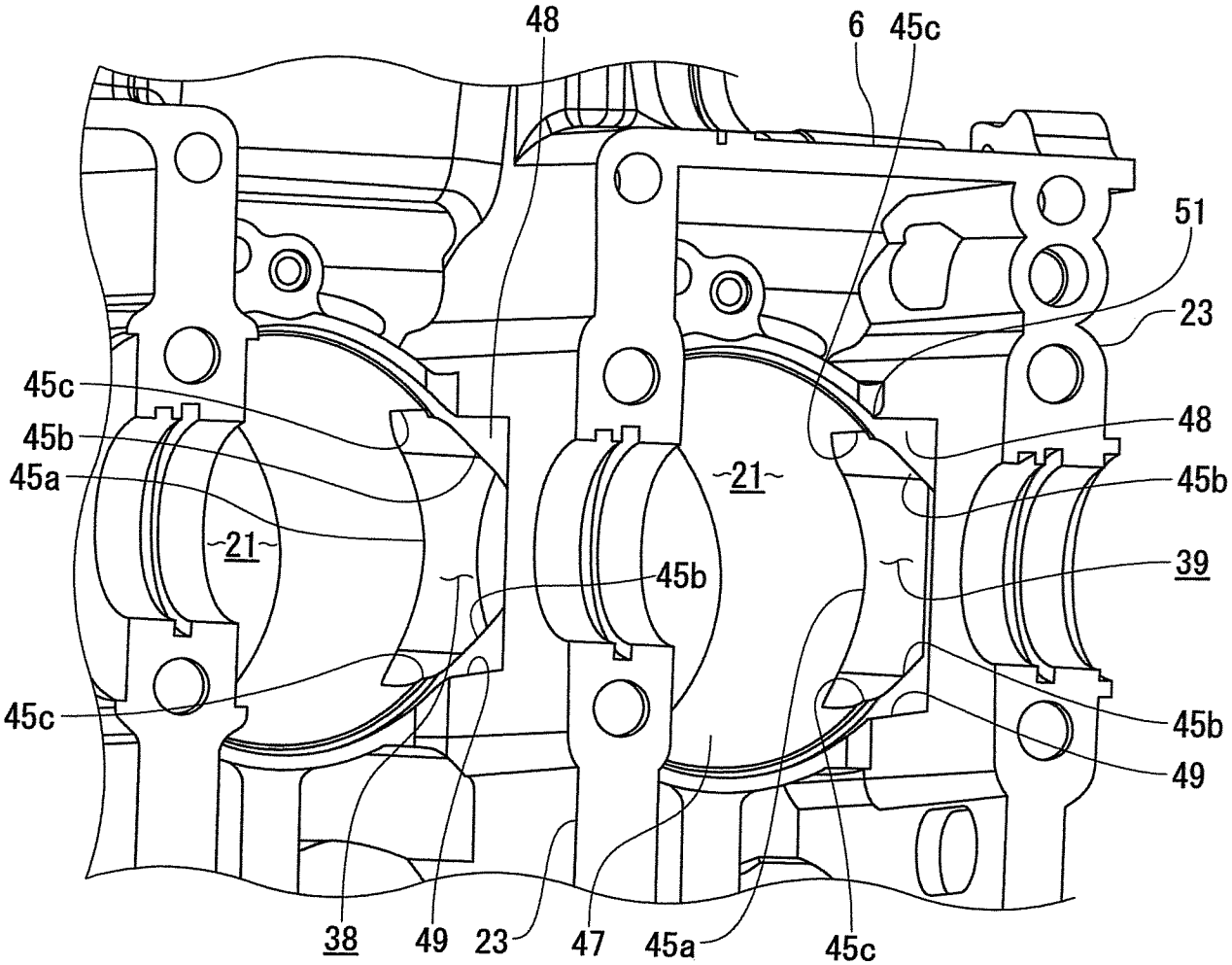
FIG. 10 is a perspective view showing the relationship between the cylinder bore and the bulkhead of the crankcase integrated cylinder block of the multi-cylinder engine according to the disclosed embodiments.

FIG. 7 is a perspective sectional view showing the communication hole region of the crankcase integrated cylinder block, FIG. 8 is an enlarged perspective view showing the communication hole region of the crankcase integrated cylinder block, FIG. 9 is a bottom view showing a relationship between the cylinder bore and the bulkhead of the crankcase integrated cylinder block, and FIG. 10 is a perspective view showing the relationship between the cylinder bore and the bulkhead of the crankcase integrated cylinder block of the multi-cylinder engine according to the present embodiment.

As shown in FIGS. 6 to 10, the crankcase integrated cylinder block 1 of a multi-cylinder engine according to this embodiment includes a cylinder axis C substantially upright with respect to a joint surface of the upper crankcase 6. A cylinder inner wall surface 47 forming the cylinder bore 21 is a slide surface with respect to the piston 26 and plated with metal such as nickel to prevent adhesion wear to the piston 26.

The crankcase integrated cylinder block 1 includes a honing release portion 48 having a cylindrical honing release surface 48*a* formed continuously with the cylinder bore 21 in the upper crankcase 6 and the upper bulkhead 23. The honing release surface 48*a* has a diameter larger than the cylinder bore 21 and forms an arcuate recessed portion 49 in the upper bulkhead 23.

The honing release portion 48 is formed in an opening edge of the cylinder bore 21 on the side of the crank chamber 22. The honing release portion 48 includes a smooth arcuate connecting surface 51 (a so-called corner R) in a boundary between the honing release portion 48 and the upper bulkhead 23.

On the other hand, the communication hole 38 of the crankcase integrated cylinder block 1 is formed from the cylinder bore 21 to the recessed portion 49. The communication hole 38 includes an opening edge 45*a* (first opening edge) on the side of the cylinder bore 21 extending in a direction substantially perpendicular to the cylinder axis C, an opening edge 45*b* (second opening edge) on the side of the crank chamber 22 having a decreasing opening width with distance from the cylinder bore 21, and an opening edge 45*c* (third opening edge) that extends substantially in parallel with the cylinder axis C and connects between the opening edge 45*a* and the opening edge 45*b*.

The communication hole 38 also includes an arcuate opening edge that smoothly connects between the opening edge 45*a* on the side of the cylinder bore 21 and the opening edge 45*c*.

The opening edge 45*b* is formed so as to provide a V-shape opened toward the cylinder bore 21, and a root of the V-shape edge is formed to have a smooth arcuate shape having an appropriate curvature. The opening edge 45*b* is formed from the cylinder bore 21 to the recessed portion 49.

In the crankcase integrated cylinder block 1 thus configured, the opening edge 45*b* formed from the cylinder bore 21 to the recessed portion 49 prevents division or separation of the honing release surface 48*a* so as to ensure a annularly continued honing release surface 48*a*.

A maximum opening width D of the communication hole 38 in a direction substantially perpendicular to the cylinder axis C is larger than a width d of the recessed portion 49 of the upper bulkhead 23. The opening edge 45*a* and the opening edge 45*c* that constitute the maximum opening width D of the communication hole 38 are positioned on the side of the cylinder bore 21.

Further, the communication hole 38 has an opening area larger than half of an area of a circle R, whose diameter is a maximum opening width W of the communication hole 38 in a direction of the cylinder axis C, on the side of the cylinder bore 21 from a center Rc of the circle R, and an opening area smaller than the area of the circle R on the side of the crank chamber 22 from the center Rc of the circle R. Further, the communication hole 38 has an opening area larger than the area of the circle R.

A flow of gas moving reciprocally in the crank chamber 22 through the communication hole 38 with reciprocation of the piston 26 is significantly influenced by the shape of the communication hole 38.

Thus, as mentioned above, the crankcase integrated cylinder block 1 of a multi-cylinder engine according to this embodiment is configured to have the opening area larger than half of the area of the circle R, whose diameter is the maximum opening width W of the communication hole 38 in the direction of the cylinder axis C, on the side of the cylinder bore 21 from the center Rc of the circle R, and the opening area smaller than the area of the circle R on the side of the crank chamber 22 from the center Rc of the circle R.

Accordingly, the crankcase integrated cylinder block 1 provides a smooth flow of gas on the side of the cylinder bore 21 of the communication hole 38 (that is, a region closer to the piston 26), and ensures a required opening area including an opening region on the side of the crank chamber 22.

Further, in the crankcase integrated cylinder block 1, with such a configuration, the opening area of the communication hole 38 can be made larger than the area of the circle R.

Moreover, in the communication hole 38 thus opened, the opening edge 45*b* opens the recessed portion 49 that constitutes a part of the honing release surface 48*a* in a V-shape, thereby providing a sufficiently large total opening area of the communication hole 38 while preventing division or separation of the honing release surface 48*a*.

Furthermore, in the crankcase integrated cylinder block 1, a curvature of the connecting surface 51 (so-called corner R) of the honing release portion 48 can be increased to enlarge the honing release surface 48*a* inward of the crank chamber 22 (as shown with broken line 51 in FIG. 8). The enlarged portion of the honing release surface 48*a* is a boundary between the cylinder bore 21 and the crank chamber 22, which may easily cause division of the honing release surface 48*a* when the opening area of the communication hole 38 is increased. Specifically, in the crankcase integrated cylinder block 1 of the multi-cylinder engine, the increase in the curvature of the connecting surface 51 (so-called, corner R) can also prevent division of the honing release surface 48*a*.

However, in this case, the connecting surface 51 is brought closer to the inside of the crank chamber 22 with enlargement of the honing release surface 48*a*, and thus, a gap between the crankshaft 27 (particularly, crank web 33) and the honing release portion 48 needs to be ensured. Thus, when the crankshaft 27 and the honing release portion 48 interfere with each other, additional machining to remove an interference range needs to be performed after plating of the cylinder bore 21 to remove the interference region.

With the crankcase integrated cylinder block 1 according to this embodiment, the communication hole 38 in which the side of the cylinder bore 21 is widely opened and the opening width decreases with distance from the cylinder bore 21 in the boundary between the cylinder bore 21 and the recessed portion 49 can provide a smooth flow of gas in a region immediately below the piston 26 at the bottom dead center, and can also prevent the division of the honing release surface 48*a*. Specifically, with the crankcase integrated cylinder block 1, it becomes possible to apply the method of blocking the end of the cylinder bore 21 on the side of the crank chamber 22 to plate the cylinder inner wall surface 47, and to also ensure a large opening area of the communication hole 38, thereby reducing the pump loss caused in a falling (downward moving) process of the piston 26, or resistance to stirring caused by oil splashed in the crank chamber 22 and mixed with air.

Therefore, as described hereinabove, with the crankcase integrated cylinder block 1 of the multi-cylinder engine according to this embodiment, the communication hole 38 having a maximum opening area can be formed in the upper bulkhead 23 that partitions the cylinder bore 21 and the crank chamber 22 without dividing the honing release surface 48*a* formed continuously with the cylinder bore 21, thus providing advantageous effects and functions.

Figure 11:
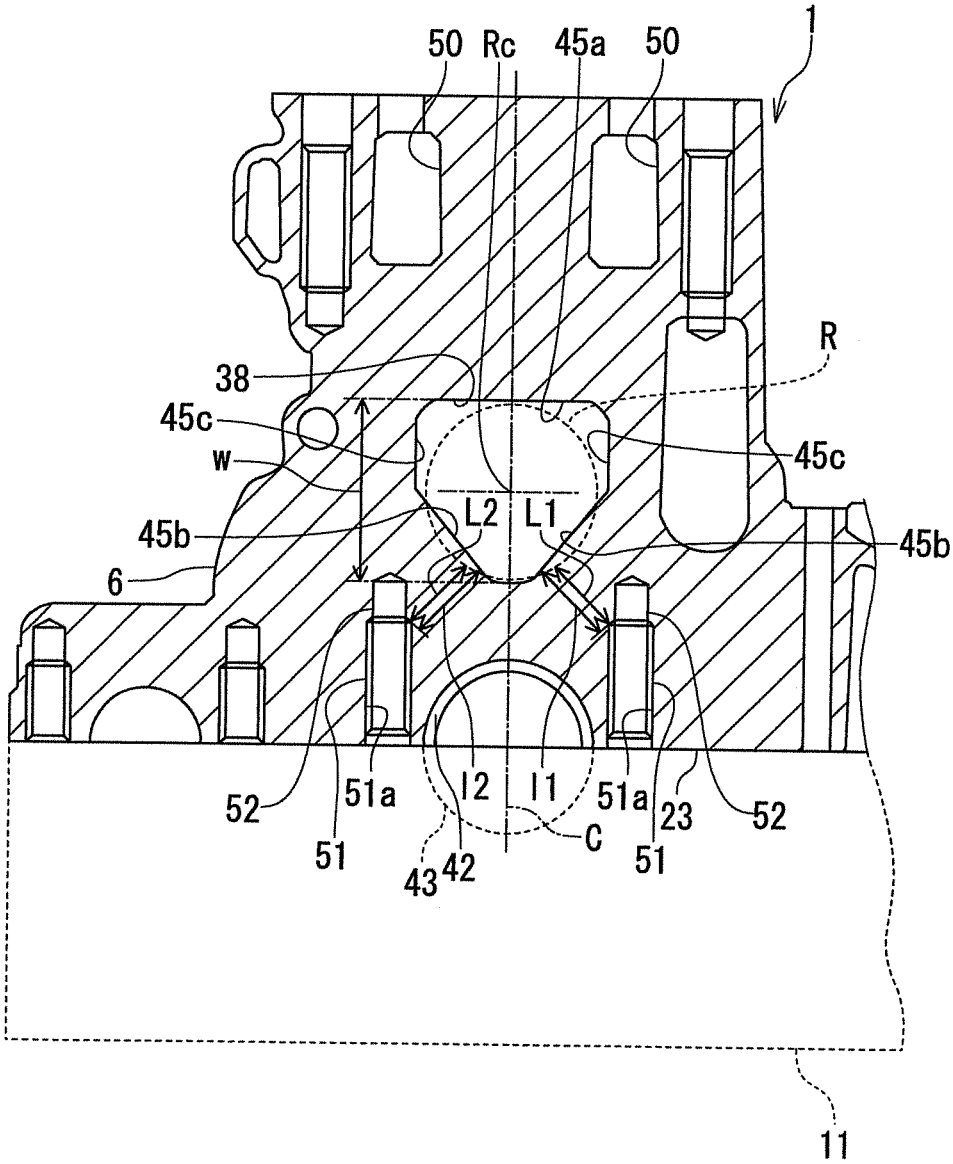
FIG. 11 is an illustrated sectional view showing a communication hole region of the crankcase integrated cylinder block of a multi-cylinder engine according to another disclosed embodiment.

Furthermore, a crankcase integrated cylinder block according to another preferred embodiment of the present invention will be described with reference to FIGS. 1-5 and FIG. 11, in which FIG. 11 is a sectional view, in an enlarged scale, of a communication hole portion of the crankcase integrated cylinder block according to another embodiment, and like or same reference numerals are added to the same or corresponding portions or components.

As described hereinbefore with reference to the aforementioned embodiment, one of the upper bulkheads 23 (herein, the upper bulkhead 23*a*) that partition the cylinder bores 21 and the crank chambers 22 placed at the ends from outside has an opening 39 having the same shape as the communication hole 38 and placed in the same straight line as the communication hole 38.

The upper bulkhead 23 includes a bearing upper half portion 42 (bearing half portion) that constitutes a journal bearing 41 in which the crankshaft 27 is journaled in a joint surface between the upper bulkhead 23 and the lower crankcase 11. On the other hand, the lower bulkhead 25 includes a bearing lower half portion 43 as a bearing cap that constitutes the journal bearing 41 together with the bearing upper half portion 42. The bearing upper half portion 42 and the bearing lower half portion 43 are arcuate grooves formed in the upper bulkhead 23 or the lower bulkhead 25, respectively.

Then, with reference to FIG. 11, particularly in combination of FIG. 3, the crankcase integrated cylinder block 1 of the multi-cylinder engine according to this embodiment includes a cylinder axis C substantially upright with respect to a joint surface of the upper crankcase 6.

The communication hole 38 in the crankcase integrated cylinder block 1 includes an opening edge 45*a* (first opening edge) on a side of the cylinder bore 21 (FIG. 3) extending in a direction substantially perpendicular to the cylinder axis C, an opening edge 45*b* (second opening edge) on a side of the crank chamber 22 (FIG. 3) having a decreasing opening width with distance from the cylinder bore 21, and an opening edge

45*c* that extends substantially in parallel with the cylinder axis C and connects between the opening edge 45*a* and the opening edge 45*b*. The communication hole 38 also includes an arcuate opening edge that smoothly connects between the opening edge 45*a* on the side of the cylinder bore 21 and the opening edge 45*c*.

The opening edge 45*b* is formed into a V-shape opened toward the cylinder bore 21, and a root of the V-shape is formed into a smooth arcuate shape having an appropriate curvature.

The communication hole 38 has an opening area larger than half of an area of a circle R, whose diameter is a maximum opening width W of the communication hole 38 in a direction of the cylinder axis C, on the side of the cylinder bore 21 from a center Rc of the circle R, and an opening area smaller than the area of the circle R on the side of the crank chamber 22 (FIG. 3) from the center Rc of the circle R.

Further, the communication hole 38 has an opening area larger than the area of the circle R.

The upper bulkhead 23 is formed with, besides the communication hole 38, a fastening hole 51 in a fastening member, not shown, for fastening, to the upper bulkhead 23, the bearing lower half portion 43 as a bearing cap that constitutes the journal bearing 41 (FIG. 3) together with the bearing upper half portion 42, and a water jacket 50 as a cooling channel for circulating cooling water or oil for cooing the cylinder block 5.

The fastening hole 51 is provided by forming a female screw portion 51*a* in a prepared hole, as a pilot hole, 52 drilled in the upper bulkhead 23, as a so-called bolt hole. The fastening hole 51 and the pilot bolt hole 52 are formed close, in position, to the bearing upper half portion 42 and the bearing lower half portion 43 (that is, the journal bearing 41) in order to reliably integrally secure the bearing upper half portion 42 and the bearing lower half portion 43.

In the crankcase integrated cylinder block 1 of a multi-cylinder engine, in a relationship between the communication hole 38 and the pilot bolt hole 52, a clearance 11 between the communication hole 38 and the pilot bolt hole 5248 is larger than a clearance L1 between the circle R whose diameter is the maximum opening width W of the communication hole 38 in the direction of the cylinder axis C and the pilot bolt hole 52. In the crankcase integrated cylinder block 1, in a relationship between the communication hole 38 and the female screw portion 51*a*, a clearance 12 between the communication hole 38 and the female screw portion 51*a* is larger than a clearance L2 between the circle R and the female screw portion 51*a*.

Generally, in a crankcase integrated cylinder block having a communication hole in a bulkhead that partitions a crank chamber, a position of an opening edge on a side of a cylinder bore of a communication hole is determined by a position at a lower end of a piston ring or a piston skirt at a lowermost stage of a piston at a bottom dead center.

Thus, the conventional crankcase integrated cylinder block has a communication hole extending in a direction perpendicular to a cylinder axis in order to increase an opening area of the communication hole. The conventional crankcase integrated cylinder block having such a configuration is disadvantage in strength because the communication hole is placed close to a bolt hole used for fastening a bearing cap.

With the crankcase integrated cylinder block 1 of a multi-cylinder engine according to this embodiment, the opening of the communication hole 38 is shaped to have the opening edge 45*a* (first opening edge) on the side of the cylinder bore 21 extending in the direction substantially perpendicular to the cylinder axis C and the opening edge 45*b* (second opening edge) on the side of the crank chamber 22 having the decreasing opening width with distance from the cylinder bore 21, maximizing the opening area of the communication hole 38 while ensuring the clearance between the pilot bolt hole 52 or the fastening hole 51 (more specifically, the female screw portion 51*a*) and the opening edge (particularly, opening edge 45*b*) of the communication hole 38. Thus, the crankcase integrated cylinder block 1 can prevent damage that may occur in the pilot bolt hole 52 or the fastening hole 51, and also reduce pump loss and resistance to stirring caused by rotation of the crankshaft 27.

A flow of gas moving upward and downward in the crank chamber 22 via the communication hole 38 with reciprocation of the piston 26 is significantly influenced by the shape of the communication hole 38.

Thus, as mentioned with reference to the afore-mentioned embodiment, the crankcase integrated cylinder block 1 according to this embodiment has the opening area larger than half of the area of the circle R, whose diameter is the maximum opening width W of the communication hole 38 in the direction of the cylinder axis C, on the side of the cylinder bore 21 from the center Rc of the circle R, and the opening area smaller than the area of the circle R on the side of the crank chamber 22 from the center Rc of the circle R. The crankcase integrated cylinder block 1 can therefore provide a smooth flow of gas on the side of the cylinder bore 21 of the communication hole 38 (that is, a region closer to the piston 26), ensures a required opening area including an opening region on the side of the crank chamber 22, and prevents damage that may occur in the pilot bolt hole 52 or the fastening hole 51.

Furthermore, in the crankcase integrated cylinder block 1 of the multi-cylinder engine according to this embodiment, with such a configuration, the opening area of the communication hole 38 can be larger than the area of the circle R.

Thus, the crankcase integrated cylinder block 1 of this embodiment can provide a sufficient clearance between the fastening hole 51 for fastening the bearing lower half portion 43 as a bearing cap or the pilot bolt hole 52 thereof and the opening edge of the communication hole 38, and improve strength and durability against damage that occurs in the fastening hole 51 or the pilot bolt hole 52.

It is further to be noted that the present invention is not limited to the described embodiments and many other changes and modifications may be made without departing from the scopes of the appended claims.

What is claimed is:

1. A multi-cylinder engine comprising:

a cylinder block including a plurality of cylinder bores;

an upper crankcase and a lower crankcase that form, in combination, a plurality of crank chambers corresponding to the cylinder bores;

a bulkhead that partitions between the cylinder bores and the crank chambers adjacent to each other; and a honing release portion having a cylindrical honing release surface formed continuously with the cylinder bore in the upper crankcase and the bulkhead, wherein the cylinder block and the upper crankcase are formed integrally, the honing release surface is formed with a diameter larger than the cylinder bore, and an arcuate recessed portion is formed in the bulkhead, the bulkhead is formed with a communication hole that communicates with the crank chambers adjacent each other, the bulkhead including a first opening edge on a side of the cylinder bore extending in a direction substantially perpendicular to a cylinder axis, a second opening edge on a side of the crank chamber having an opening width decreasing with a distance from the cylinder bore, and a third opening edge that extends substantially in parallel with the cylinder axis and connects between the first opening edge and the second opening edge, and the second opening edge is formed from the cylinder bore to the recessed portion to prevent the honing release surface from being divided.

2. The multi-cylinder engine according to claim 1, wherein the communication hole has a maximum opening width in a direction substantially perpendicular to the cylinder axis, which is larger than a width of the recessed portion.

3. The multi-cylinder engine according to claim 1, wherein the first opening edge and the third opening edge are disposed, in position, on a side of the cylinder bore.

4. A multi-cylinder engine comprising:

a cylinder block including a plurality of cylinder bores;

an upper crankcase and a lower crankcase that form, in combination, a plurality of crank chambers corresponding to the cylinder bores, the upper crankcase being formed integrally with the cylinder block; and a bulkhead that partitions between the cylinder bores and the crank chambers adjacent to each other, wherein the bulkhead is formed with:

a communication hole that includes a first opening edge on a side of the cylinder bore extending in a direction substantially perpendicular to a cylinder axis and a second opening edge on a side of the crank chamber having an opening width decreasing with a distance from the cylinder bore so as to establish communication between the cylinder bores and the crank chambers adjacent to each other;

a bearing half portion that constitutes a journal bearing in which a crankshaft is journaled in a joint surface between the bearing half portion and the lower crankcase; and a pilot bolt hole as a fastening hole for a fastening member for fastening, to the bulkhead, a bearing cap that constitutes the journal bearing together with the bearing half portion, and wherein a clearance between the communication hole and the pilot bolt hole is larger than a clearance between a circle whose diameter is a maximum opening width of the communication hole in a direction of the cylinder axis and the pilot bolt hole.

5. The multi-cylinder engine according to claim 4, wherein the fastening hole is formed with a female screw portion, and a clearance between the communication hole and the female screw portion is larger than a clearance between the circle and the female screw portion.

6. The multi-cylinder engine according to claim 4, wherein the communication hole has a first opening area at a position of the cylinder bore side from a center of the circle and a second opening area at a position of the crank chamber side from the center of the circle, the first opening area is larger than half of an area of the circle, and the second opening area is smaller than half of the area of the circle.

7. The multi-cylinder engine according to claim 4, wherein the communication hole has an opening area larger than the area of the circle.

* * * * *